United States Patent [19]

Login et al.

[11] Patent Number: 4,622,038

[45] Date of Patent: Nov. 11, 1986

[54] LOW RESIDUE FIBER SPIN FINISHES

[75] Inventors: Robert B. Login, Middletown, Pa.; Michael J. Anchor, Canton Township, Wayne County, Mich.

[73] Assignee: BASF Corporation, Wyandotte, Mich.

[21] Appl. No.: 695,308

[22] Filed: Jan. 28, 1985

[51] Int. Cl.[4] ..... D06M 15/19

[52] U.S. Cl. ..... 8/115.6; 252/8.9

[58] Field of Search ..... 8/115.6; 252/8.8, 8.9; 568/862

[56] References Cited

U.S. PATENT DOCUMENTS 3,036,118 5/1962 Jackson et al. ..... 260/484

4,110,227 8/1978 Newkirk et al. ..... 252/8.9

*Primary Examiner*—Paul Lieberman

*Assistant Examiner*—John F. McNally

*Attorney, Agent, or Firm*—William G. Conger; Joseph D. Michaels

[57] ABSTRACT

Polyoxyalkylated 2,2-dialkyl-1,3-propanediols which produce exceptionally low residues in pan tests at elevated temperatures are disclosed for use in fiber finishing operations.

18 Claims, No Drawings

LOW RESIDUE FIBER SPIN FINISHES

BACKGROUND OF THE INVENTION

1. Field of the Invention

The subject invention relates to fiber spin finishes containing fiber lubricants which produce low residue levels. More particularly, the invention relates to the use of polyoxyalkylene polyether diols based upon 2,2-dialkyl-1,3-propanediols as spin finish lubricant additives.

2. Description of the Related Art

Fiber finishing compositions are a necessary part of modern, high speed synthetic fiber manufacture. Virtually all operations performed on the fibers following their being spun from the melt require the presence of suitable fiber finishes to prevent snarling and breaking, thus enabling higher fiber throughput. Generally speaking, a quality fiber finish must provide several, often conflicting qualities. For example, the fiber finish must qualify both the interaction between the fiber and the machinery on which it is processed, and also the interactions among the fiber filaments themselves. This property is usually termed "lubricity" although in reality the change in the interactions caused by the fiber lubricant may sometimes result in a desirable increase in friction as well as the decrease in friction ordinarily associated with the term "lubricant."

In addition to its "lubricant" qualities, the fiber finish composition must control static electricity generated during fiber processing. Generally, ionic organic compounds such as synthetic phosphate and sulfonate detergents are useful as antistats and are added to the fiber finish composition for this purpose.

The fiber finishes are generally applied in the form of an aqueous emulsion by any one of several methods including the use of kiss rolls, sprayers, baths and squeeze rollers, and grooved ceramic guides and metering pumps. To maintain a stable emulsion of the lubricant and antistat components, surfactants such as fatty alcohol oxyethylates and nonylphenol oxyethylates are generally necessary.

A suitable fiber finish must also be easily removable from the fiber or yarn so as not to interfere with subsequent operations such as dyeing and bleaching. Furthermore, since the finish performs its intended functions only on the outside of the fiber, it should not be easily absorbed into the fiber proper. Penetration of the fiber lubricant into the fiber increases the quantity of lubricant required during the finishing operation and, in addition, may cause undesirable changes in the physical properties of the fibers themselves.

As the fiber throughput associated with modern fiber finishing operations have increased, the demands placed upon the fiber finish, especially the lubricant which comprises a major portion of the finish, have increased as well. In drawing and twisting operations, for example, the fiber is drawn across a heater plate, hot draw roll or heating pin in order to raise the temperature of the fiber to the plastic deformation stage. The fibers then undergo stretching, twisting, tangling, or a combination of these operations. The cooled, stretched fiber generally has a much higher tensile strength than the raw fiber. If the fiber has been twisted or tangled in addition to being stretched, it retains these modifications, thus imparting improved feel, fabric cover, recovery from deformation and other properties felt desirable by the textile industry. The fibers may also be textured by processes such as stuffer-tube crimping and edge crimping. These processes also require the fibers to be heated to the same relatively high temperatures as for drawing and twisting, generally in the neighborhood of 190° C. or higher.

As the fiber throughput increases, the temperature of the heating elements must be increased as well in order for the faster moving fibers to be heated to the requisite processing temperatures. Fiber processing machinery is capable of running at speeds in excess of 1000 m/min. At these high speeds, however, the primary heater plate temperature must be maintained at temperatures of 250° C. or higher to enable sufficient heat transfer to the fast moving fibers. At these high temperatures, prior art lubricants resinify causing a rough resinous coating to cover the heater plate. This buildup of resinous coating on the heater plate not only causes decreased thermal transfer from the plate to the fiber but, more importantly, is a primary cause of broken filaments. The need for a fiber lubricant which will not build up resinous deposits at high temperatures has heretofore limited operating speeds to 700 to 800 m/min. for this reason. In addition to causing broken filaments, the resinous heater plate deposits may adhere to the fibers, causing additional problems such as uneven dyeing in subsequent operations owing to the greater difficulty in removing the resinous by-products as opposed to the unaltered lubricants themselves.

Due to the loss of production time necessitated by cleaning operations or, in some cases equipment replacement, caused by buildup of fiber finish residue, low residue is important even for lower speed operations, or operations with heavy denier fibers. Although the buildup of residue is much slower under the lower temperature conditions of slower fiber finishing, eventually a residue level is reached which requires cleaning and replacement operations to be performed. Thus fiber lubricants which yield low residue are important for both low as well as high speed fiber processing.

Prior art lubricants include mineral oils and waxes, fatty acid esters such as butyl stearate, vegetable oils and waxes, neoalcohol esters, silicones, and polyoxyalkylene polyethers. Among the fiber lubricants yielding the least resinous buildup for high speed fiber processing, for example, are the propylene oxide/ethylene oxide block copolymers such as PLURONIC® L-31 block copolymer surfactant. In pan tests at 210°, for example, PLURONIC® L-31 typically has less than 3 percent by weight unvolatized residue after four hours and less than 1 percent after 24 hours. However, even these relatively small amounts of residue can produce resinous buildup on the heater plates when processing speeds of greater than 700 to 800 m/min. are utilized. Thus, the requirement of a low residue fiber lubricant suitable for high speed fiber processing has not been met in spite of the long-felt need for such a product.

SUMMARY OF THE INVENTION

It is therefore an object of the subject invention to enable higher fiber processing speeds or less process down-time or both by utilizing a low-residue lubricant additive in the fiber finish. This objective was unexpectedly met by the use of fiber lubricants which are polyoxyalkylene glycols based upon 2,2-dialkyl-1,3-propanediols as initiator molecules. These products correspond to the formula:

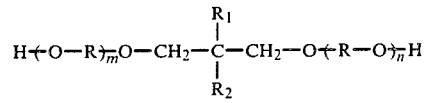

wherein R is the alkylene portion of a 2 to 4 carbon oxyalkylene residue, m and n are integers such that the average value of the sum (m+n) is less than about 30, and $R_1$ and $R_2$ are individually selected from the group consisting of alkyl radicals having from 1 to 8 carbon atoms. These polyoxyalkylene glycols exhibit exceptionally low residues when used in fiber processing operations.

DESCRIPTION OF THE PREFERRED EMBODIMENTS

The fiber lubricants of the subject invention are produced by the addition polymerization of one or more oxiranes or other cylic ethers onto an initiator molecule which is selected from the group consisting of 2,2-dialkyl-1,3-propanediols. Examples of suitable indicator molecules, for example, include 2,2-dimethyl-1,3-propanediol, 2,2-diethyl-1,3-propanediol, 2,2-dipropyl-1,3-propanediol, 2,2-diisopropyl-1,3-propanediol, 2,2-dibutyl-1,3-propanediol, and 2-ethyl-2-methyl-1,3-propanediol.

The 2,2-dialkyl-1,3-propanediol initiators are available commercially or may be synthetized by procedures familiar to the organic chemist, for example, by the reaction of suitably substituted aldehydes in an aldol condensation or by the acid catalyzed ring opening of suitably substituted oxetanes. The preparation of 2-alkyl-2-methyl-1,3-propanediols, for example, is the subject of U.S. Pat. No. 4,097,540 wherein substituted acroleins (acrylaldehydes) are reacted with formaldehyde, followed by reduction.

Preferred 2,2-dialkyl-1,3-propanediols are 2,2-dimethyl-1,3-propanediol, 2,2-diethyl-1,3-propanediol, and 2-ethyl-2-methyl-1,3-propanediol. Especially preferred because of its ready availability and low cost is 2,2-dimethyl-1,3-propanediol.

The 2,2-dialkyl-1,3-propanediol initiator is oxyalkylated by means of a ring-opening condensation polymerization with one or more cyclic ethers in the presence of either a basic catalyst or a Lewis acid catalyst. Basic catalysis is preferred. Suitable basic catalysts are alkali metal and alkaline earth metal hydroxides such as lithium hydroxide, sodium hydroxide, potassium hydroxide, calcium hydroxide, and barium hydroxide. Preferably used are sodium hydroxide and potassium hydroxide. Alkali metal alkoxides such as sodium methoxide and potassium methoxide are also suitable. Generally, the amount of catalyst required is from 0.01 percent to 2 percent by weight of the initiator charge.

Suitable cyclic ethers include the oxiranes, such as oxirane, methyloxirane, 1,2-dimethyloxirane, and ethyloxirane. Methyloxirane is especially preferred. In addition to oxiranes, oxetane and tetrahydrofuran are also suitable for the practice of the invention. When the latter are used, Lewis acid catalysis is preferred. Suitable Lewis acid catalysts are aluminum chloride and boron trifluoride etherate.

The oxyalkylation may be performed by addition of only one cyclic ether, by addition of mixtures of cyclic ethers, or by alternating addition of individual cyclic ethers or their mixtures. Generally, from 1 to about 60 moles of cyclic ether per mole of initiator may be utilized. Preferably, from 2.5 to about 12 moles of cyclic ether is added.

By these methods, considerable flexibility may be built into the lubricant structure so that frictional qualities (lubricity), wetability, emulsifiability, smoke point, fiber compatibility, and compatibility with other fiber finish components may be altered over a comparatively wide range. Thus, block polyethers, heteric polyethers, block-heteric polyethers and other variations are all possible. These polyethers must have the 2,2-dialkyl-1,3-propanediyl structure in order to possess the low residue characteristics of the fiber lubricants of the subject invention.

The most preferred embodiments of the subject invention are those fiber lubricants prepared by the ring-opening condensation polymerization of methyloxirane onto 2,2-dimethyl-1,3-propanediol as the initiator. These polyoxyalkylene polyethers give uniquely low residue values in pan tests. These lubricants may be used alone, or preferably with other lubricants such as those having lower coefficients of friction but higher levels of residue in fiber spin finishing operations. The lubricants are also advantageously utilized either alone or in admixture with other fiber lubricants in the processing of heavier denier fibers and yarns as, for example, those utilized in tire cord fabrics. The examples which follow serve to illustrate the invention but do not serve to limit it in any way.

EXAMPLE 1

A 2.5 mole methyloxirane adduct of 2,2-dimethyl-1,3-propanediol was prepared. A one-gallon stainless steel autoclave was charged with 833 grams (8.0 mole) of 2,2-dimethyl-1,3-propanediol and 8.4 grams (0.067 mole) of 45 percent by weight aqueous potassium hydroxide. Under a blanket of nitrogen, the mixture was heated to 130° C., and stripped free of water. The pressure was adjusted to 0 to 3 psig with nitrogen and 1160 grams (20.0 mole) of methyloxirane was added at the rate of 200 to 250 g/hr. After the last of the methyloxirane had been added, the mixture was held for three hours to insure complete reaction. The crude mixture was then cooled to 80° C. and 57 g magnesium silicate was added. After one hour of stirring, the crude product was filtered and volatiles removed in vacuo. The clear, water-white product had a hydroxyl number of 463 (450 calculated), an aqueous cloud point at 1 percent concentration of 100° C., a surface tension at 0.1 percent concentration of 55.1 dynes/cm, and a viscosity of 234 SUS at 100° F. (37.8° C.). A pan test of the lubricant at 210° C. yielded only 0.06 percent residue after 24 hours. The lubricant was tested on the Rothchild F-meter where a coefficient of friction of 0.47 relative to butyl stearate (0.35) was obtained.

EXAMPLE 2

A 10.4 mole methyloxirane adduct of 2,2-dimethyl-1,3-propanediol was prepared. The procedure of Example 1 was followed, with an initial charge of 458 grams of 2,2-dimethyl-1,3-propanediol. Aqueous 45 percent potassium hydroxide, 12.1 grams was added as catalyst, the water stripped, and was followed by addition of a total of 2330 grams of methyloxirane, of which 100 grams was vented after a reaction period of approximately 15 hours, including the three hour holding period. The lubricity of the product was measured on the Rothchild F-meter. The coefficient of friction, relative to butyl stearate, was 0.50. Two pan tests of the product conducted at 210° showed 0.007 percent and 0.000 percent residue after 24 hours, respectively.

Comparison Tests

Several commercial lubricants were pan tested at 210° C. for 24 hours. The results of these tests and tests of the products of Examples 1 and 2 are summarized below:

| Lubricant | % residue | |
|---|---|---|
| | Trial 1 | Trial 2 |
| Tween-60 | 39.3 | 43.1 |
| Drakeol 5 | 2.2 | 3.1 |
| Coconut Oil | 58.4 | 61.8 |
| PLURONIC ® Polyol L-31 | 0.7 | 0.9 |
| Lubricant of Example 1 | 0.06 | no second trial |
| Lubricant of Example 2 | 0.007 | 0.000 |

The embodiments of the invention in which an exclusive privilege or property is claimed are defined as follows:

1. In a process for finishing synthetic fiber or yarn involving the application to the surface of said fiber or yarn of a fiber finishing composition containing antistats, emulsifiers, surfactants, and one or more fiber lubricants, the improvement comprising adding to the fiber finish composition, a friction-modifying lubricant having the formula:

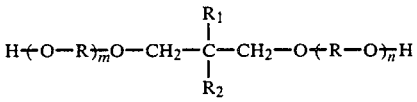

wherein R is the alkylene portion of a 2 to 4 carbon oxyalkylene residue, m and n are integers such that the average value of the sum (m+n) is less than about 30, and $R_1$ and $R_2$ are individually selected from the group consisting of alkyl radicals having from 1 to 8 carbon atoms.

2. The process of claim 1 wherein $R_1$ and $R_2$ are individually selected from the group consisting of methyl, ethyl, 1-propyl, 2-propyl, and butyl radicals.

3. The process of claim 1 wherein $R_1$ and $R_2$ are methyl.

4. The process of claim 1 wherein $R_1$ and $R_2$ are ethyl.

5. The process of claim 1 wherein $R_1$ is methyl and $R_2$ is ethyl.

6. The process of claim 1 wherein said oxyalkylene residue is derived from a cyclic ether selected from the group consisting of oxirane, methyloxirane, 1,2-dimethyloxirane, ethyloxirane, oxetane, and tetrahydrofuran.

7. The process of claim 6 wherein said cyclic ether is methyloxirane.

8. The process of claim 6 wherein $R_1$ and $R_2$ are methyl and wherein said cyclic ether is methyloxirane.

9. The process of claim 1 wherein the sum of (m+n) is about 10 or less.

10. The process of claim 2 where the sum of (m+n) is about 10 or less.

11. The process of claim 3 wherein the sum of (m+n) is about 10 or less.

12. The process of claim 6 wherein the sum of (m+n) is about 10 or less.

13. The process of claim 7 wherein the sum of (m+n) is about 10 or less.

14. The process of claim 8 wherein the sum of (m+n) is about 10 or less.

15. The process of lubricating a synthetic fiber with a fiber lubricant during fiber processing wherein said fiber lubricant comprises:

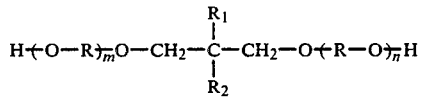

wherein R is the alkylene portion of a 2 to 4 carbon oxyalkylene residue, m and n are integers such that the average value of the sum (m+n) is less than about 30, and $R_1$ and $R_2$ are individually selected from the group consisting of alkyl radicals having from 1 to 8 carbon atoms.

16. The process of claim 15, wherein $R_1$ and $R_2$ are methyl, R is an alkylene residue containing from 2 to 3 carbon atoms and wherein the sum (m+n) is less than about 20.

17. In a composition useful in synthetic fiber finishing operations containing fiber lubricants, antistats, emulsifiers, biocides, antioxidants and other additives, the improvement comprising, employing as one of said fiber lubricants a compound having the following formula:

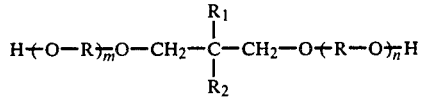

wherein R is the alkylene portion of a 2 to 4 carbon oxyalkylene residue, m and n are integers such that the average value of the sum (m+n) is less than about 30, and $R_1$ and $R_2$ are individually selected from the group consisting of alkyl radicals having from 1 to 8 carbon atoms.

18. The composition of claim 17 wherein $R_1$ and $R_2$ are methyl, R is an alkylene residue containing from 2 to 3 carbon atoms and wherein the sum (m+n) is less than about 20.

* * * * *